US005094003A

United States Patent [19]

Schwab

[11] Patent Number: 5,094,003

[45] Date of Patent: Mar. 10, 1992

[54] PAPER WEB CUTTING AND RETRACTING TOOL

[76] Inventor: Albert J. Schwab, 3076 N. Lexington Ave., Roseville, Minn. 55113

[21] Appl. No.: 709,313

[22] Filed: Jun. 3, 1991

[51] Int. Cl.[5] ..... B26B 9/02; B26B 27/00; B26B 1/00; B26B 11/00

[52] U.S. Cl. ..... 30/329; 30/90.4; 30/349; 7/161

[58] Field of Search ..... 30/329, 90.4, 294, 314, 30/315, 337, 342, 349; 7/161

[56] References Cited

U.S. PATENT DOCUMENTS

| | | | |
|---|---|---|---|
| 245,049 | 8/1881 | Bean . | |
| 1,268,997 | 6/1918 | Pruett . | |
| 1,748,869 | 2/1930 | Drennan | 30/294 |
| 2,017,369 | 10/1935 | McGhee | 7/161 |
| 2,098,123 | 11/1937 | Wood . | |
| 2,178,710 | 11/1939 | Valiquette | 30/349 |
| 2,238,678 | 4/1941 | Cook . | |
| 2,482,805 | 9/1949 | Stafford . | |
| 2,736,962 | 3/1956 | Putmon . | |
| 3,325,835 | 6/1967 | Burns et al. | 7/161 |
| 3,751,806 | 8/1973 | Patrick | 30/315 |
| 3,831,274 | 8/1974 | Horrocks | 30/90.4 |
| 3,921,288 | 11/1975 | Clemens, Jr. | 7/161 |

*Primary Examiner*—Douglas D. Watts
*Assistant Examiner*—Paul M. Heyrana
*Attorney, Agent, or Firm*—Leo Gregory

[57] ABSTRACT

A long handled tool having a blade member at one end having a leading undercutting knife edge to sever from a web a broken end portion thereof which is wrapped about a drying roller and having an adjacent portion of the blade having an extended tapered curved terminal portion, the knife edge being inserted between layers of the web wrapped about the roller and the roller itself, moving the blade member along the roller the width of the web severing the web and then moving the blade member to one side of the cut to engage the wrapped portion of the web with the curved terminal portion to pull the broken web off of the roller.

4 Claims, 2 Drawing Sheets

PAPER WEB CUTTING AND RETRACTING TOOL

This application is a substitute for application Ser. No. 481,903 filed Sept. 24, 1990.

BACKGROUND OF THE INVENTION

1. Field of Invention

This invention relates to the web of a paper making machine.

2. Description Of The Prior Art

Paper is formed as a web passing over and under successive drying rollers. When a break in the web occurs, the oncoming end of the web wraps itself about the roller around which it is engaged until the rotation of the rollers is stopped.

A series of rollers in parallel relationship in a paper making machine may extend for a city block or more and the rollers are from three to six feet in diameter and from ten to twenty-six feet in length. The web may be traveling up to 1200 feet per minute. The rollers are shut down rapidly when a break in a web occurs but at the point of the break, the forward broken end of the web in wrapping itself about a roller can accommodate to a thickness of layers of the web about a roller up to as much as three and one half inches by the time the rollers are stopped.

When a break occurs, down time is a direct loss. The cost of operation may be on the order of a thousand dollars per hour. Hence down time loss is an important factor.

The tool presently used is a hook at the end of a pole inserted under the layers of wrap about a roller at the far end of a web where the remote edge is engaged and the operator pulls the hook through the web breaking the same apart. This separates the wrapped portion of the web from the oncoming web and said separated portion is pulled off of the roller. The down time here ranges from ten to thirty minutes depending upon the number of layers of the wrapped portion.

The pole mounted hook .for removing the wrapped portion of a web is the only known tool to be presently in use and has been in use for many years.

Pole mounted hooks are known to be used in the logging industry and for rupturing walls and ceilings in fire fighting as in McGhee U.S. Pat. No. 2,017,369.

SUMMARY OF THE INVENTION

It is an object of this invention to provide a substantially improved instrument to cut free from a web a broken end portion thereof wrapped about a drying roller and to remove the same from the roller.

It is another object of this invention to provide a combination tool carried at the end of a pole, the tool having a replaceable knife blade at its forwardly facing end portion and having a rearwardly terminal curved portion.

It is a further object of this invention to provide a cutting tool which is readily positioned between a paper web wrap about a roller and the roller wherein a forward movement of the tool readily severs the web and a retraction or withdrawal of the tool is adapted to remove the severed web portion from the roller.

More particularly it is an object of this invention to provide a tool for severing the portion of a web wrapped about a drying roller with an undercutting replaceable blade and having integral therewith and rearwardly facing from said blade, a terminal portion for removing from the drying roller the severed portion of said web.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a broken view in perspective showing the invention in an operating position;

DESCRIPTION OF A PREFERRED EMBODIMENT

Figure 2:
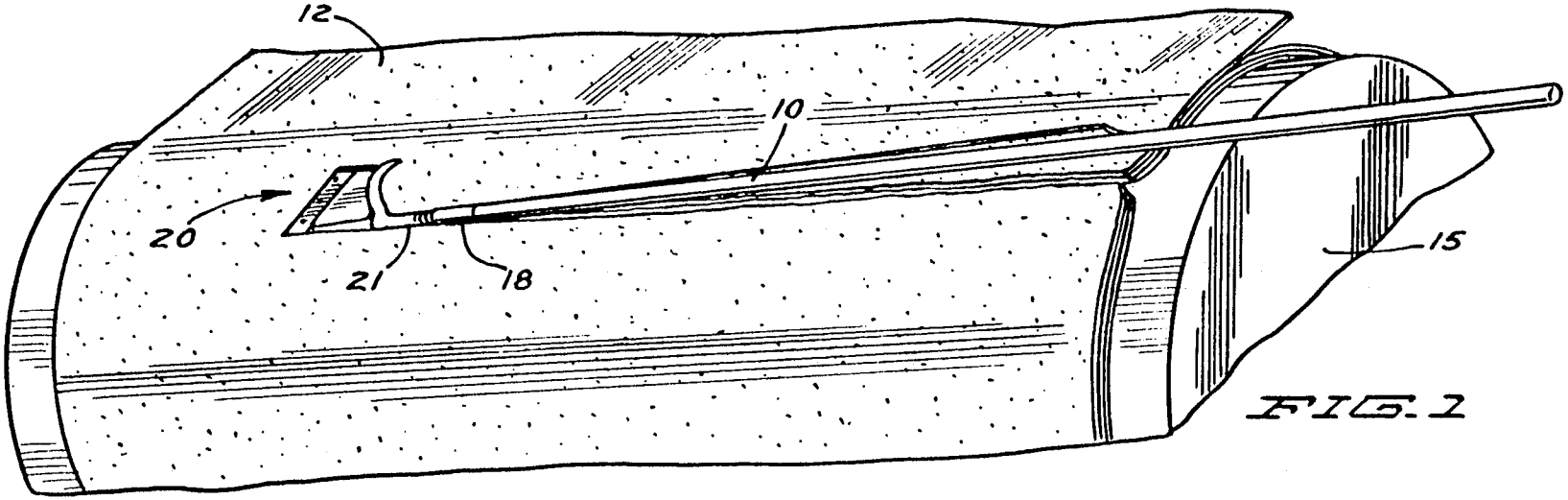
FIG. 2 is a view similar to that of FIG. 1 showing the invention in another operating position.
Figure 2:
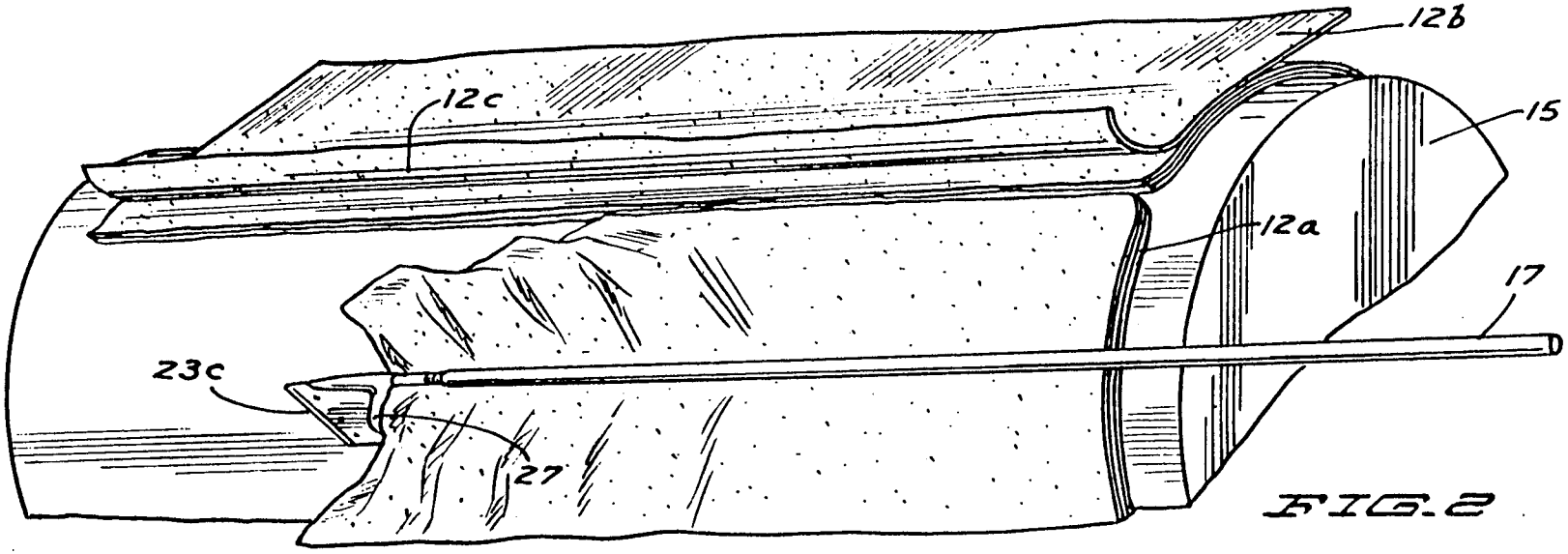
Figure 3:
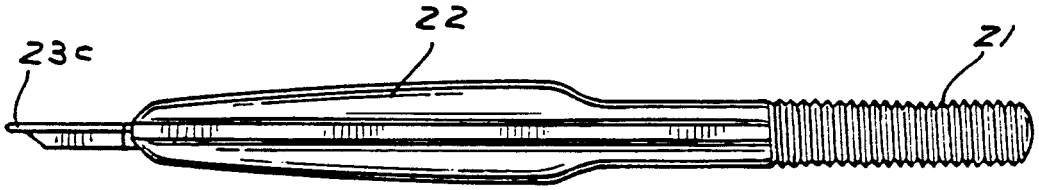
FIG. 3 is a top plan view of the head portion of the invention.
Figure 4:
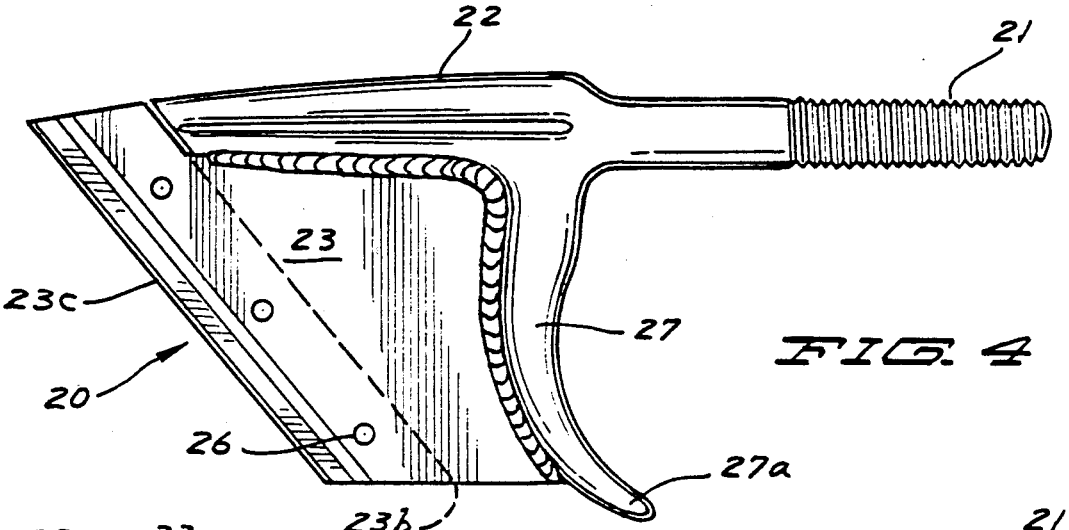
FIG. 4 is a view similar to that of FIG. 3 in side elevation.
Figure 5:
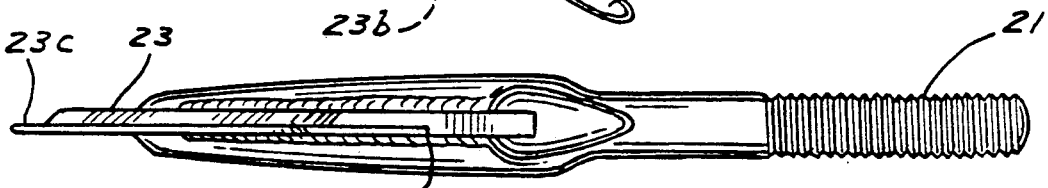
FIG. 5 is a view similar to that of FIG. 4 in bottom plan.

Referring to FIGS. 1 and 2, the invention herein comprising a paper web cutting and removing tool is indicated generally by the reference numeral 10.

Said tool is shown in operating position as if upon a broken end portion of a paper web 12 consisting of several layers **12*a* thereof wrapped about a drying roller 15**.

Said tool consists of a long handle 17 which will be of a length to reach the far end of a roller. Said handle has a terminal socket 18 into which is secured the threaded shank 21 of a blade 20, the shank having a small thickness.

Figure 7:
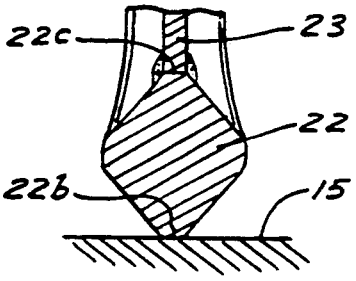
FIG. 7 is a broken view in cross section taken on line 7—7 of FIG. 4 as indicated.

Said blade is integral with said shank which is cylindrical in cross section and rearwardly extending. The forward extension of said shank is a base portion 22 which is substantially rectangular in cross section as in FIG. 7 and resting on an edge portion **22*b*. Upstanding from the edge portion 22*c* which is opposed thereto and secured thereto as by welding is a blade member 23**.

Figure 6:
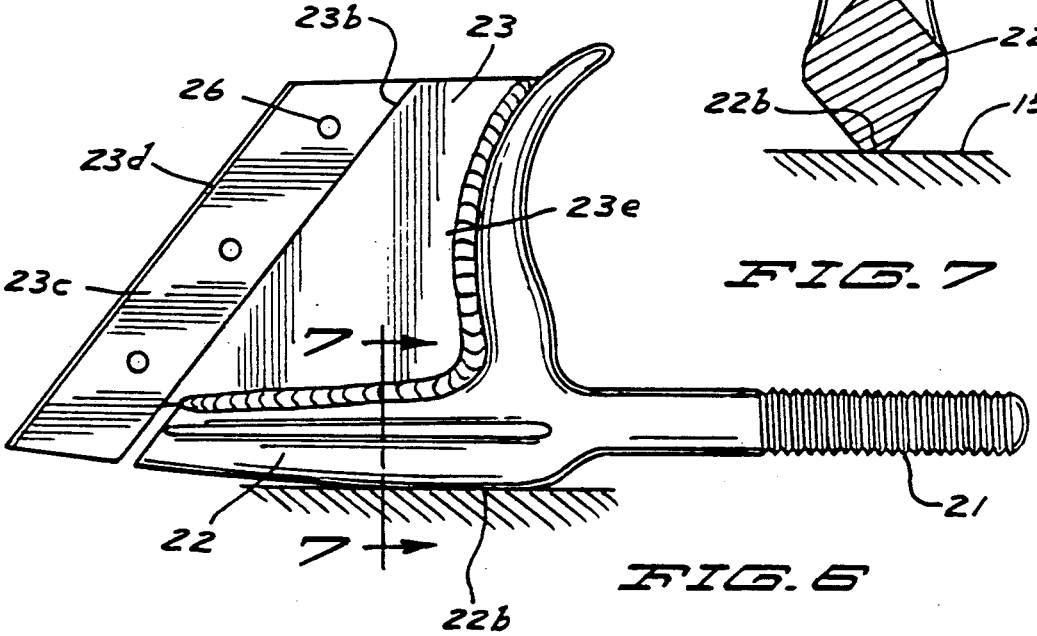
FIG. 6 is a view in side elevation showing the other side of the view of FIG. 4.

The leading edge portion of said blade at **23*b* is recessed to form an offset to receive a replaceable cutting blade insert 23*c* the full length thereof which is secured by bolts 26. Said blade insert is formed of a particularly well hardened steel to make a very sharp cutting edge. With the blade positioned as in FIG. 6, the forward edge 23*d* thereof is angled upwardly and rearwardly to undercut the web 12 as in FIG. 1**.

Extending from said shank and formed along the rear edge **23*e* of said blade is a tapered terminal portion 27 thereof which is concavely curved and which projects beyond said blade, terminating in an end portion 27*a***.

As indicated, the paper web passes over and under successive rollers and when a break in the web occurs, the advancing forward end will wrap itself about whichever roller the break took place. The number of wraps about the dryer will depend upon how quickly the rollers can be stopped. The layered web portion **12*a* wrapped about a roller must be severed from the oncoming web portion 12*b* leading up to it. The severed end of the oncoming web is indicated at 12*c***.

The web because of its composition is difficult to cut. Hence the practice has been to engage the far side of the web with a hook and by drawing the hook with sufficient force across the web, to break apart or rupture the web and draw it off the roller.

With the invention herein the practice is being changed. The leading edge of the blade is inserted between the layered web 12*a* and the roller 15 on the near side of the roller to undercut the web. Then by using a handle of a length to extend to the far side of the roller, the blade member is pushed along the roller on its edge 22*b* with the cutting blade 23*c* very efficiently cutting the web as at 12*c*. When the far side of the roller is reached, the blade member, extending beyond the web, is reversed to insert the curved terminal 27 to engage the web at the side of the cut 12*c* remote from the oncoming web 12*b* and the severed wrapped portion of the web 12*a* is pulled free of the roller. The edge portion 22*b* slides along the roller easily and the blade member moves very readily thereon.

The removal of the wrapped portion of the web using the tool of the invention herein can be accomplished in something like 3½ to 5 minutes whereas the presently used tool in the industry requires upwardly of 30 minutes. In view of the cost of operation, the savings in down time is very significant.

The invention herein has been introduced to some paper making mills and proved to be a revelation in expediting the process of removing a broken end portion of a web wrapped about a roller.

One of the salient features of the invention is the replaceable blade 23*c* which is readily exchanged for a newly sharpened blade thereby assuring a sharp cutting edge to be in use.

It will of course be understood that various changes may be made in form, details, arrangement and proportions of the product without departing from the scope of the invention, which, generally stated, consists in a product capable of carrying out the objects above set forth, in the parts and combination of parts disclosed and defined in the appended claims.

What is claimed is:

1. A paper web cutting tool comprising a shank having a small thickness and having a forward extension thereof, said extension having a base portion and an upstanding portion at a substantial angle thereto, a blade member disposed between said base portion and said upstanding portion and means securing the same thereto, said blade member having its leading edge angled inwardly from said base portion toward said upstanding portion, a recess formed the length of the leading edge of said blade member, a cutting blade removably disposed into said recess and means removably securing the same therein, and a pole of adequate length connected to said shank.

2. The structure of claim 1, wherein upstanding portion has a tapered terminal portion extending beyond said blade member.

3. The structure of claim 1, wherein said blade member being welded to said base portion and said upstanding portion thereof.

4. The structure of claim 1, wherein said cutting blade extending beyond the length of said recess.

* * * * *